US007021792B2

(12) United States Patent
Lin

(10) Patent No.: US 7,021,792 B2
(45) Date of Patent: Apr. 4, 2006

(54) ROPE LIGHT HAVING A MULTI-CIRCUIT ARRANGEMENT

(76) Inventor: Yuan Lin, 5 Viewmont Court, Doncaster East 3109 Vic. (AU)

( * ) Notice: Subject to any disclaimer, the term of this patent is extended or adjusted under 35 U.S.C. 154(b) by 10 days.

(21) Appl. No.: 10/716,521

(22) Filed: Nov. 20, 2003

(65) Prior Publication Data

US 2004/0252503 A1 Dec. 16, 2004

(30) Foreign Application Priority Data

Jun. 13, 2003 (CN) ..... 092116190

(51) Int. Cl.
*F21P 1/00* (2006.01)
*F21S 13/14* (2006.01)

(52) U.S. Cl. ..... 362/252; 362/249; 362/391; 362/219

(58) Field of Classification Search ..... 362/249, 362/219, 250, 251, 391, 238, 252

See application file for complete search history.

(56) References Cited

U.S. PATENT DOCUMENTS

| | | | | |
|---|---|---|---|---|
| 5,155,669 | A * | 10/1992 | Yamuro | 362/252 |
| 6,406,166 | B1 | 6/2002 | Ko | 362/249 |
| 6,502,955 | B1 | 1/2003 | Ko | 362/219 |
| 6,527,412 | B1 | 3/2003 | Ko | 362/249 |
| 6,604,841 | B1 * | 8/2003 | Liu | 362/252 |
| 6,830,358 | B1 * | 12/2004 | Allen | 362/226 |
| 2005/0024834 | A1 * | 2/2005 | Newby | 361/719 |

* cited by examiner

*Primary Examiner*—Thomas M. Sember
*Assistant Examiner*—James W Cranson, Jr.
(74) *Attorney, Agent, or Firm*—Troxell Law Office, PLLC

(57) ABSTRACT

A rope light having a multi-circuit arrangement is disclosed. The light comprises a plurality of electrical wires longitudinally extended therealong; and one or more pairs of first and second illuminating units, each pair being electrically coupled between any two electrical wires, each illuminating unit including a plurality of LEDs coupled in series, and the first and the second illuminating units in each pair being connected in parallel. Applying AC source between any two electrical wires sequentially will lighten up the first and the second illuminating units in each pair alternately by enabling current to flow through the LEDs in each illuminating unit toward a predetermined direction when the LEDs are conducted. The invention can control on/off of a plurality of LEDs by means of a relative small number of electrical wires.

6 Claims, 6 Drawing Sheets

| | 21 | 22 | 23 | 24 | 25 | 26 |
|---|---|---|---|---|---|---|
| 11 | $V^+$ | V | ∞ | ∞ | $V^-$ | $V^+$ |
| 12 | $V^-$ | $V^+$ | $V^+$ | $V^-$ | ∞ | ∞ |
| 13 | ∞ | ∞ | $V^-$ | $V^+$ | $V^+$ | $V^-$ |

ROPE LIGHT HAVING A MULTI-CIRCUIT ARRANGEMENT

BACKGROUND OF THE INVENTION

1. Field of the Invention

The present invention relates to rope light and more particularly to such a rope light having a multi-circuit arrangement with improved characteristics.

2. Description of Related Art

Conventionally, lamps on a single-circuit of a rope light can be turned on/off by means of a controller coupled between two electrical wires. Also, lamps on a double-circuit of the rope light can be turned on/off by means of the controller coupled among three electrical wires (i.e., increase of an additional electrical wire). Likewise, three-circuit of the rope light can be turned on/off by means of the controller coupled among four electrical wires, etc. In an extreme example, six-circuit of the rope light can be turned on/off by means of the controller coupled among seven electrical wires, resulting in a bulkiness of the rope light.

In U.S. Pat. Nos. 6,406,166, 6,527,412, and 6,502,955 there are disclosed a chasing rope light. For example, U.S. Pat. No. 6,406,166 (the prior art) is characterized in that two illuminating units each having a plurality of illuminators (e.g., LEDs) are provided in a single-circuit of the rope light having two electrical wires, and three (or four) illuminating units are provided in a double-circuit (or multi-circuit) thereof having three electrical wires (see FIGS. 4, 5 and 6). Also, a diode is provided in each of the illuminating units. The diode is adapted to permit current to flow in only one direction in a conducted state if a sufficient voltage is applied thereon. As shown, any two adjacent diodes are disposed oppositely with respect to polarity. As such, the purpose of controlling the lightening sequence of the illuminating units in a multi-circuit arrangement of the rope light can be obtained. In other words, the lightening sequence of the illuminating units in the multi-circuit arrangement of the rope light is totally controlled by diodes which are thus essential to the prior art.

However, the prior art, by incorporating a plurality of diodes, suffered from several disadvantages. For example, (1) the prior art did not know that an LED is also adapted to permit current to flow in only one direction in a conducted state if a sufficient voltage is applied thereon. Thus, provision of LEDs as illuminators is sufficient to control the lightening sequence of the illuminating units. In other words, provision of diodes as on/off device in controlling the lightening sequence of the illuminating units is not necessary. To the worse, it results in an increase in the manufacturing cost, an increase of size, and a limitation on the number of circuits in the rope light.

(2) As shown in FIGS. 3 and 7 of the prior art, the illuminators are preferably implemented as LEDs as described in the specification. Instead, the illuminators are lamps as shown. Hence, it is concluded that the LEDs as described in the specification are simply lamp-based LEDs. Typically, the lamp-based LED or simply lamp has two rigid pins adapted to fixedly insert in a circuit board rather than that described in FIGS. 3 and 7 which show the lamps are coupled in series. The pins of the illuminators have to be bent outward to couple to the conductive wire prior to wrapping around the electrical wires 20A, 20B (see FIGS. 3 and 7). Thus, two problems are occurred. One is that the pins are susceptible of damage in the bending process. As such, the lamp, as encapsulated by epoxy, tends to malfunction in bending. It is known that the pin is rigid while the electrical wire is non-rigid. Hence, when the electrical wire is wrapped around the pin it is very difficult (or even impossible) of tightly securing them together, though the pins are not damaged by bending. Such wrapping is not reliable as viewed by an experienced electrical technician. Instead, per wire connecting rules of electrical engineering it requires that first mounts a small copper socket in the pins of a LED, and then secures them together by soldering in order to fasten the pins and the electrical wire together. This has a benefit of being capable of withstanding an increased stress. However, the technique of mounting the socket in the pins has disadvantages of being tedious, time consuming, and cost ineffective, though it is applicable.

(3) Of course, it is possible of wrapping a wire around the pins of the lamp-based LED. However, in view of the accompanying drawings of the prior art, such coupled LEDs may be too large to mount in the rope light, though it is applicable in view of FIG. 3. However, as shown in FIG. 7, a portion of the long pin is exposed. Hence, a bending of the LED will cause a short circuit in the exposed portion of the pin. Moreover, the illuminators are preferably LEDs as described in the specification. But, there is no disclosure about how to avoid the use of diode and stress exerted on the pins and the rope light.

Thus, it is desirable to provide an improved rope light in order to overcome the above drawbacks of the prior art.

SUMMARY OF THE INVENTION

It is an object of the present invention to provide a rope light having a multi-circuit arrangement. By utilizing the rope light, advantages such as elimination of diodes, simple circuit arrangement, saving of electrical wires, compactness, control the lightening sequence of illuminating units, and reduction of manufacturing cost can be obtained.

It is another object of the present invention to provide a rope light having a benefit of controlling on/off of LEDs (light emitting diodes) by means of a relative small number of electrical wires. For example, it is possible of controlling the on/off of six LEDs by means of three electrical wires.

It is a further object of the present invention to provide a rope light in which an illuminating unit thereof is implemented as a plate-shaped LED or COB (chip on board) type LED which is fixed on a circuit board by soldering extended conductive wires on the circuit board. By utilizing the rope light, benefits such as improvement of electrical connection to LEDs, increase of stress withstanding capability, simplification of circuit arrangement, significant saving of electrical wires, lightweight, and compactness can be obtained.

The above and other objects, features and advantages of the present invention will become apparent from the following detailed description taken with the accompanying drawings.

DETAILED DESCRIPTION OF THE PREFERRED EMBODIMENTS

The invention is directed to a rope light having a multi-circuit arrangement. The invention is devised by distinguishing itself from the narrow prior art after considerable research and experimentation. Also, the inventor adopts the most advanced semiconductor manufacturing technology and fully understands the properties of LED. The rope light of the invention is characterized as follows: No provision of diodes. Instead, the illuminators are implemented as LEDs which are served as both illuminating devices and diodes. As such, component cost of the rope light is greatly reduced due to, as stated above, the elimination of diodes. Also, the manufacturing process is shortened in time and the manufacturing cost is reduced. The LED is implemented as a plate-shaped LED, COB type LED, SMD (surface mounting) LED, or LED dice bonding which is again fixed on a circuit board by soldering extended conductive wires on the circuit board. As such, benefits such as facilitation of the manufacturing process, improvement of electrical connection to LEDs, prevention of short circuit of electrical wires, increase of stress withstanding capability, compactness, significant saving of illuminators, lightweight, and flexibility can be obtained.

The rope light of the invention should operate in conjunction with connector and controller. However, they are well known. Thus a detailed description thereof is omitted herein for the sake of brevity.

Figure 1:
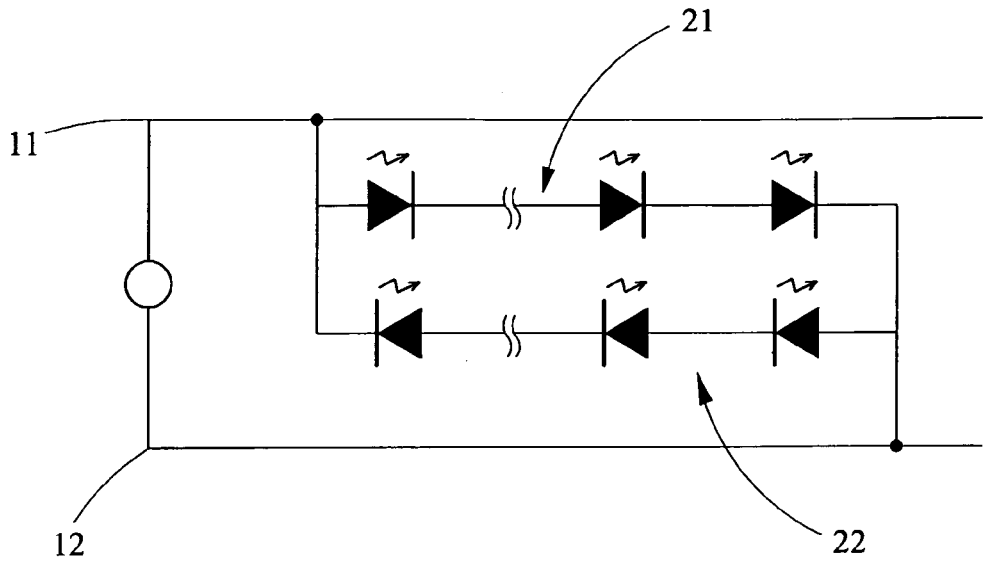
FIG. 1 is a circuit diagram of a first preferred embodiment of rope light according to the invention where a single-circuit arrangement is illustrated.
Figure 2:
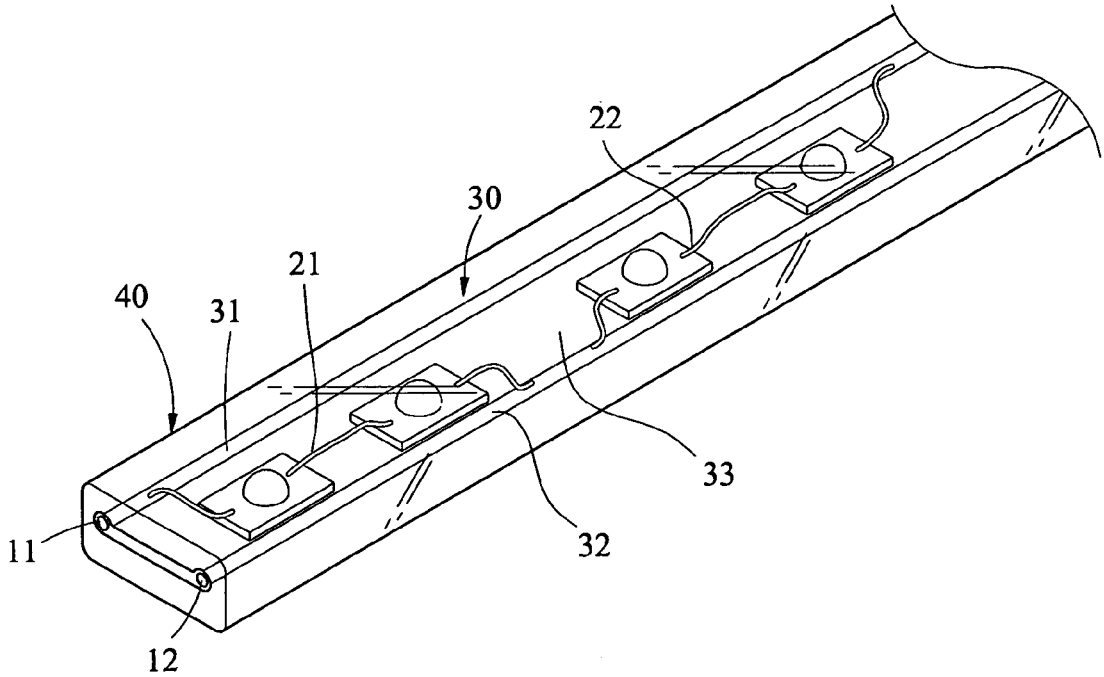
FIG. 2 is a perspective view of the rope light shown in FIG. 1.

Referring to FIGS. 1 and 2, a rope light having a multi-circuit arrangement constructed in accordance with a first preferred embodiment of the invention comprises two electrical wires 11, 12, a first illuminating unit 21 including a plurality of LEDs between the electrical wires 11 and 12, a second illuminating unit 22 including a plurality of LEDs also between the electrical wires 11 and 12 and in parallel with the first illuminating unit 21, and a controller (not shown) electrically coupled to the electrical wires 11, 12. As shown, a positive terminal of the first illuminating unit 21 is electrically coupled to the first electrical wire 11 while a negative terminal thereof is electrically coupled to the second electrical wire 12. To the contrary, a positive terminal of the second illuminating unit 22 is electrically coupled to the second electrical wire 12 while a negative terminal thereof is electrically coupled to the first electrical wire 11. When connecting with the controller (not shown) for providing different current directions between the electrical wires 11 and 12, the LEDs of the first illuminating unit 21 will be lightened up sequentially with the LEDs of the second illuminating unit 22 off if the current is positive. To the contrary, the LEDs of the second illuminating unit 22 will be lightened up sequentially with the LEDs of the first illuminating unit 21 off if the current is negative. A flashing effect of the rope light is observed when ac (alternating current) is fed to the electrical wires 11 and 12. In other words, the invention can achieve the flashing effect without the provision of diodes.

Referring to FIG. 2 specifically, the rope light is enclosed in an outer cover layer 40 which has a flat rectangular, square, or oval section as detailed later. Moreover, the LEDs may be replaced by lamps, Christmas bulbs, strip bulbs, or ornamental bulbs in other embodiments. In the embodiment, each of the illuminating units 21, 22 is implemented as a COB type LED, SMD LED, or LED dice bonding which is again fixed on a small circuit board by soldering. As shown, two conductive wires extended from the circuit board are inserted into an elongated, axial groove 33 of an elongated mounting strap 30. The mounting strap 30 has two side ridges 31, 32 with the electrical wires 11, 12 disposed therein respectively. The illuminating units 21, 22 are thus electrically coupled to the electrical wires 11, 12. The outer cover layer 40 is then formed around the mounting strap 30 by means of injection molding. By configuring as above, the rope light of the invention is structurally strong enough while possessing an acceptable degree of flexibility.

Figure 3:
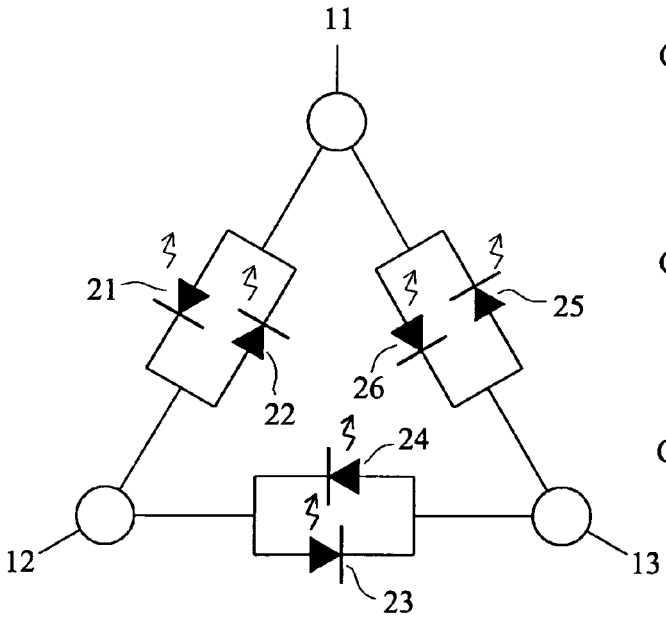
FIG. 3 is an equivalent circuit diagram of a second preferred embodiment of rope light according to the invention where a multi-circuit arrangement is illustrated.
Figures 6, 7:
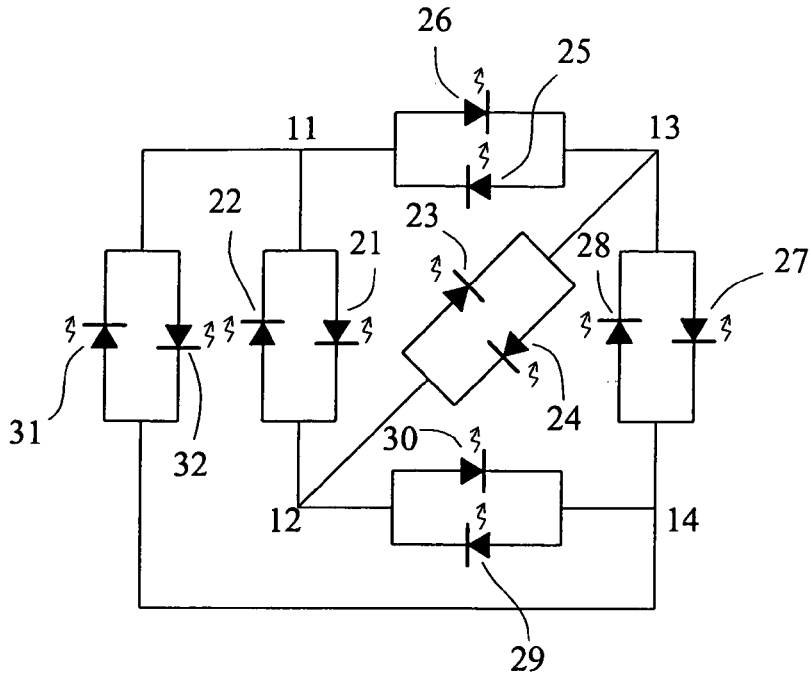
FIG. 6 is an equivalent circuit diagram of a third preferred embodiment of rope light according to the invention where a multi-circuit arrangement is illustrated.
FIG. 7 is a table showing on-off sequence of the illuminating units in different electrical wires according to the second preferred embodiment.

Referring to FIGS. 3 and 7, a second preferred embodiment of the invention is illustrated. A leak current will be generated between positive and negative terminals of a circuit when a load (e.g., illuminator) therebetween is lightened up. For example, a leak current will be generated between the positive and the negative terminals of the electrical wires 11, 12. The leak current will flow from the first electrical wire 11 to the second electrical wire 12 via the illuminating units 26 and 24. As such, the illuminating units 24 and 25 (or the illuminating units 23 and 26) should be eliminated for preventing the leak current if the illuminators thereof are implemented as typical lamps. Otherwise, the illuminating units 24 and 25 (or the illuminating units 23 and 26) may lighten up undesirably. For overcoming this problem, all illuminators are implemented as LEDs by the invention while maintaining the original multi-circuit arrangement. This is because an LED is adapted to permit current to flow in only one direction (i.e., very small resistance) in a conducted state while blocking current from flowing in an opposite direction (i.e., very large resistance or off) if a sufficient, predetermined voltage is applied thereon. As shown in FIG. 7, when positive voltage is applied to the first electrical wire 11 with respect to the second electrical wire 12, the illuminating unit 21 will be lightened up while other illuminating units are off (i.e., open circuit). To the contrary, when positive voltage is applied to the second electrical wire 12 with respect to the first electrical wire 11 due to the characteristic of ac, the illuminating unit 22 will be lightened up white other illuminating units are off (i.e., open circuit). Likewise, when positive voltage is applied to the second electrical wire 12 with respect to the third electrical wire 13, the illuminating unit 23 will be lightened up while other illuminating units are off (i.e., open circuit). To the contrary, when positive voltage is applied to the third electrical wire 13 with respect to the second electrical wire 12, the illuminating unit 24 will be lightened up while other illuminating units are off (i.e., open circuit). Similarly, when positive voltage is applied to the third electrical wire 13 with respect to the first electrical wire 11, the illuminating unit 25 will be lightened up while other illuminating units are off (i.e., open circuit). To the contrary, when positive voltage is applied to the first electrical wire 11 with respect to the third electrical wire 13, the illuminating unit 26 will be lightened up while other illuminating units are off (i.e., open circuit).

Thus, it is possible of controlling on/off of six LEDs by means of three electrical wires according to the multi-circuit arrangement of the invention.

Figure 4:
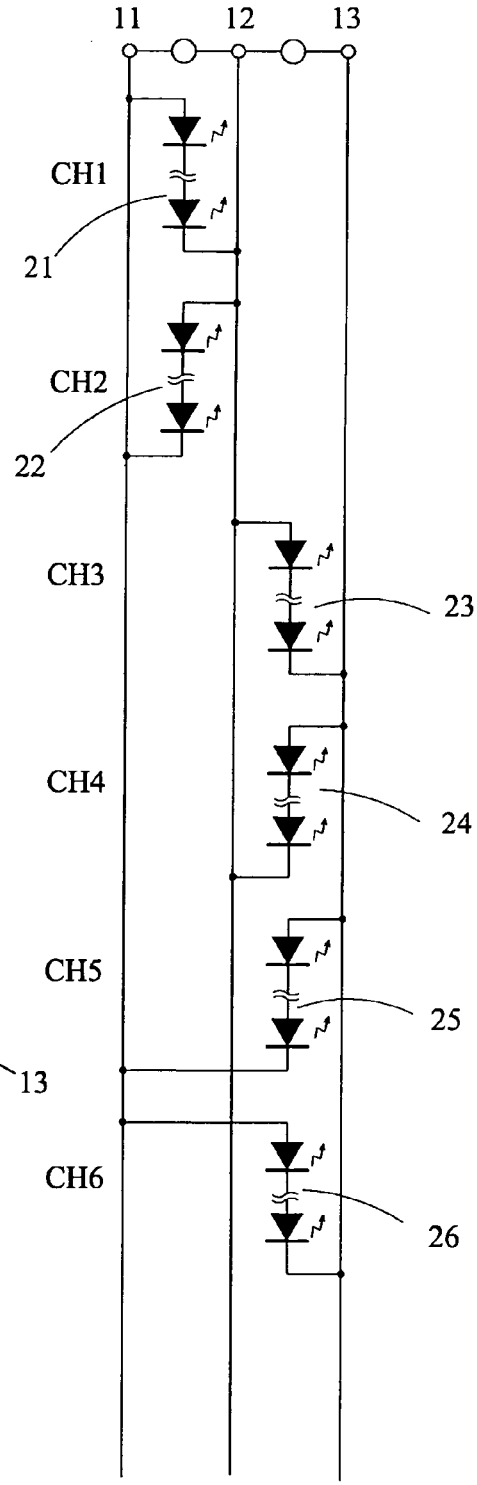
FIG. 4 is a circuit diagram of the second preferred embodiment of rope light.

Referring to FIG. 4, a second preferred embodiment of the invention is shown. The second preferred embodiment substantially has same structure as the first preferred embodiment. The differences between the first and the second preferred embodiments, i.e., the characteristics of the second preferred embodiment are detailed below. A third electrical wire 13 is added. Also, the illuminating units of the rope light comprise six LEDs 21, 22, 23, 24, 25, and 26. The first illuminating unit 21 comprises a plurality of LEDs between the electrical wires 11 and 12. The second illuminating unit 22 comprises a plurality of LEDs also between the electrical wires 11 and 12 and in parallel with the first illuminating unit 21. The positive terminal of the first illuminating unit 21 is electrically coupled to the first electrical wire 11 while the negative terminal thereof is electrically coupled to the second electrical wire 12. To the contrary, the positive terminal of the second illuminating unit 22 is electrically coupled to the second electrical wire 12 while the negative terminal thereof is electrically coupled to the first electrical wire 11. Likewise, the third illuminating unit 23 comprises a plurality of LEDs between the electrical wires 12 and 13. The fourth illuminating unit 24 comprises a plurality of LEDs also between the electrical wires 12 and 13 and in parallel with the third illuminating unit 23. The positive terminal of the third illuminating unit 23 is electrically coupled to the second electrical wire 12 while the negative terminal thereof is electrically coupled to the third electrical wire 13. To the contrary, the positive terminal of the fourth illuminating unit 24 is electrically coupled to the third electrical wire 13 while the negative terminal thereof is electrically coupled to the second electrical wire 12. Similarly, the fifth illuminating unit 25 comprises a plurality of LEDs between the electrical wires 13 and 11. The sixth illuminating unit 26 comprises a plurality of LEDs also between the electrical wires 13 and 11 and in parallel with the fifth illuminating unit 25. The positive terminal of the fifth illuminating unit 25 is electrically coupled to the third electrical wire 13 while the negative terminal thereof is electrically coupled to the first electrical wire 11. To the contrary, the positive terminal of the sixth illuminating unit 26 is electrically coupled to the first electrical wire 11 while the negative terminal thereof is electrically coupled to the third electrical wire 13.

Figure 5A:
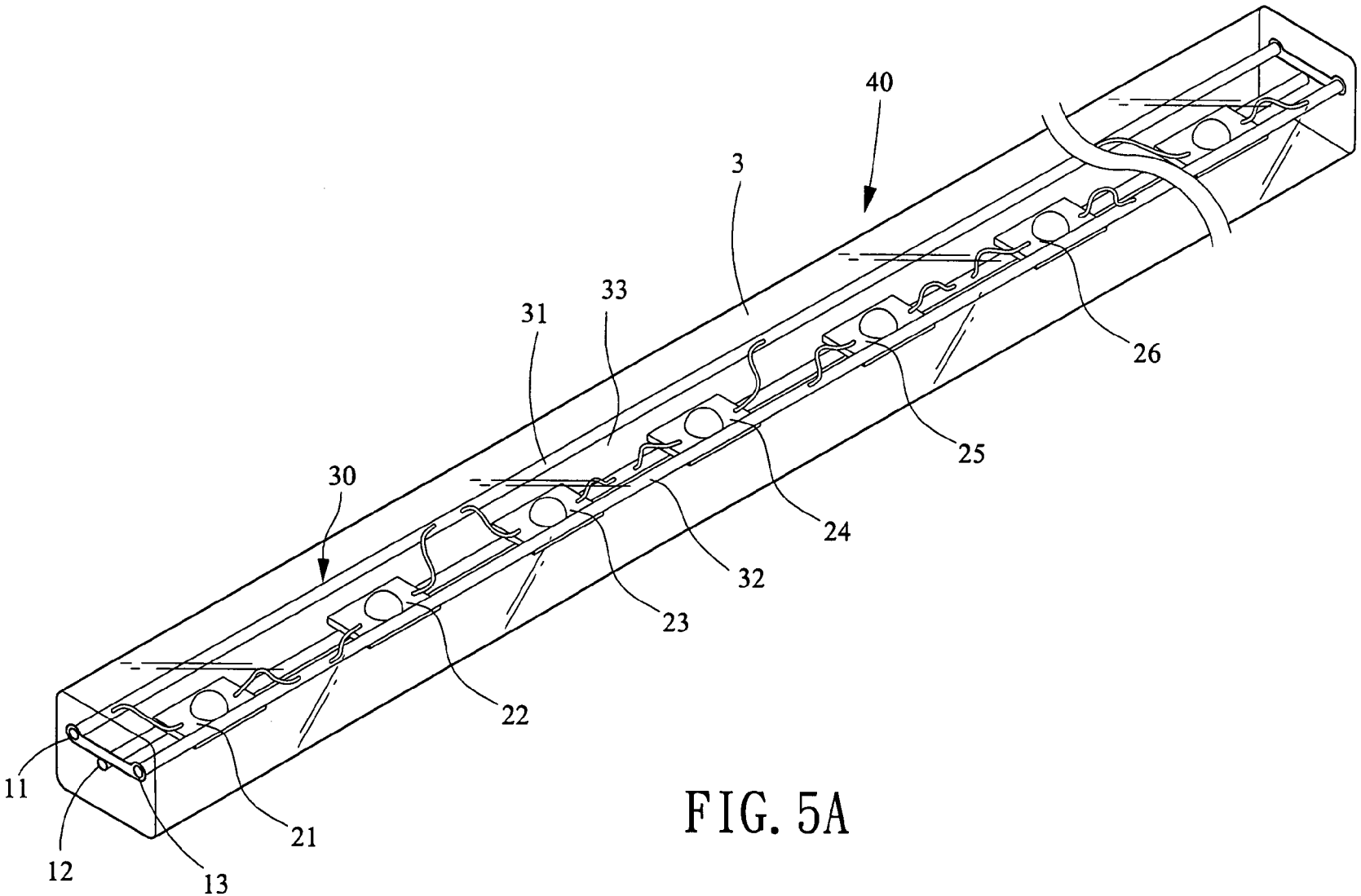
FIG. 5A is a perspective view illustrating a first alternative mode of the rope light having a square section.
Figure 5B:
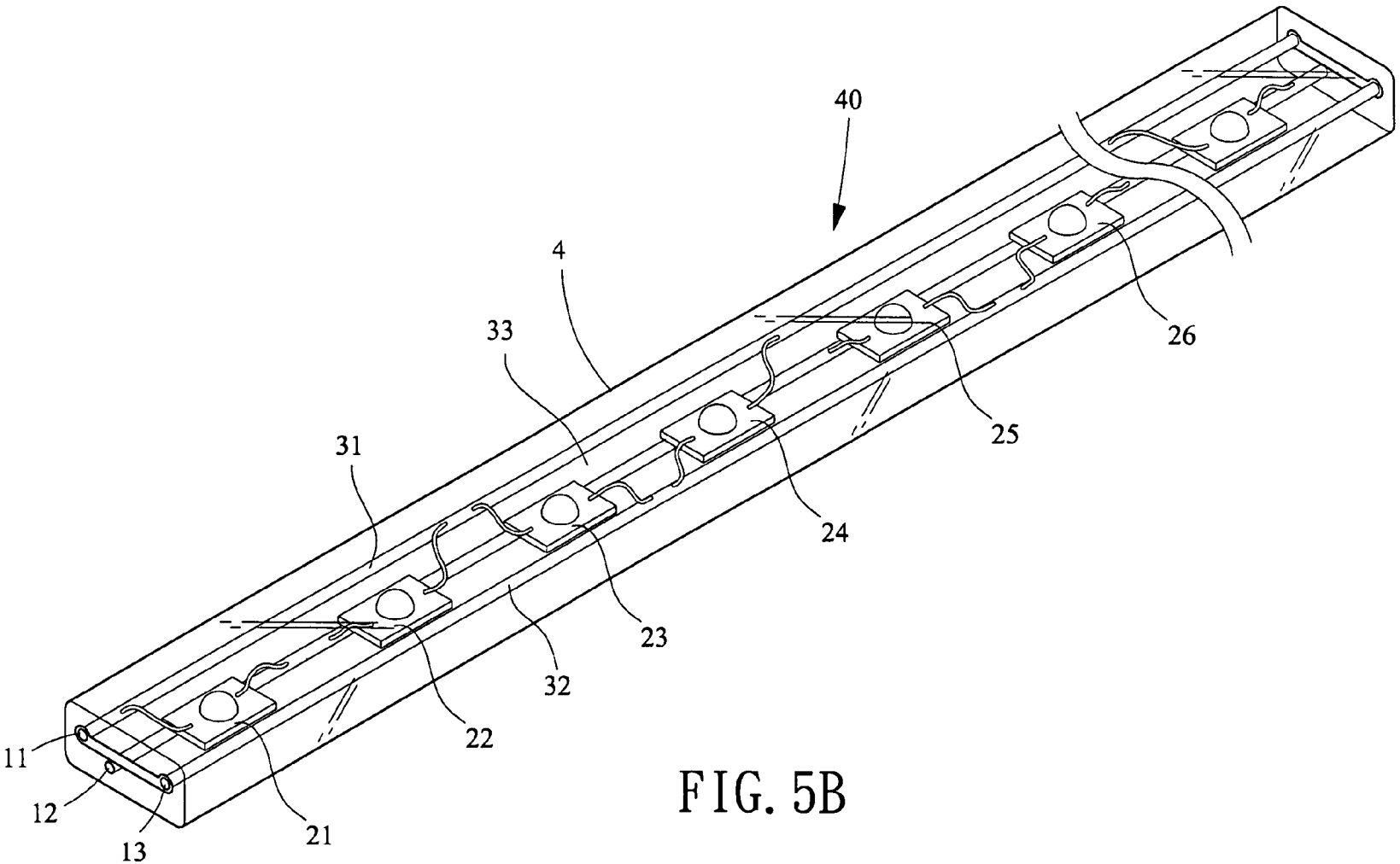
FIG. 5B is a perspective view illustrating a second alternative mode of the rope light having a flat, rectangular section.
Figure 5C:
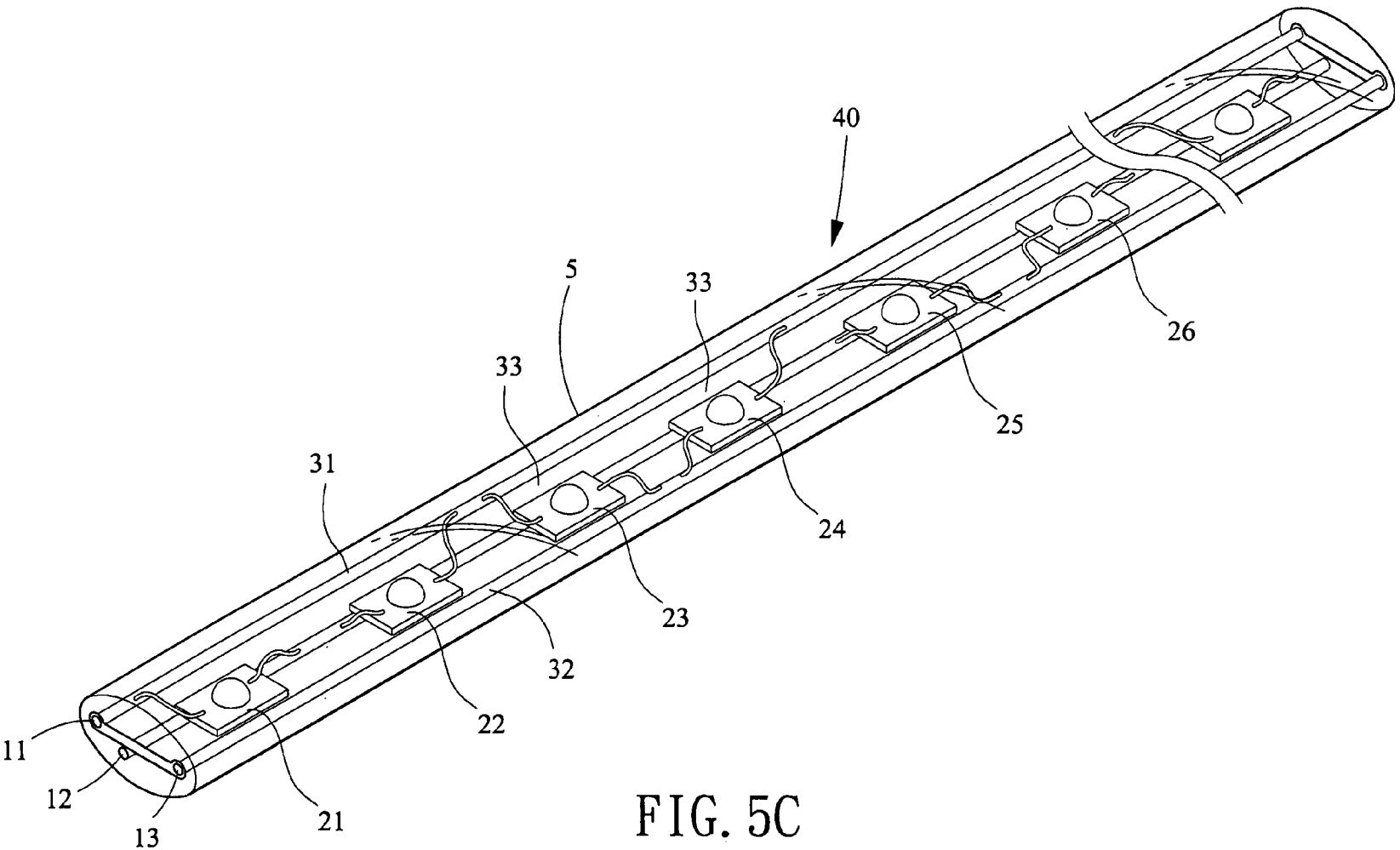
FIG. 5C is a perspective view illustrating a third alternative mode of the rope light having an oval section.

Referring to FIGS. 5A, 5B, and 5C, the rope light having a section of square 3, flat rectangle 4, and oval 5 are shown respectively. The rope light in each of FIGS. 5A, 5B, and 5C is constructed substantially the same as that shown in FIG. 2 except that the former has three electrical wires and three pairs of LEDs while the latter has only two electrical wires and two pairs of LEDs.

Moreover, in the embodiment shown in FIG. 5A, 5B, or 5C, the electrical wires 11, 12 are fixed in the side ridges 31, 32 respectively while the electrical wire 13 is disposed under the mounting strap 30. Next, couple six LEDs 21 to 26 among the electrical wires 11, 12, and 13 as illustrated in FIG. 4. Finally, the outer cover layer 40 having a section of square 3, flat rectangle 4 or oval 5 is formed around the mounting strap 30 by means of injection molding. By configuring as above, the rope light of the invention is structurally strong enough while possessing an acceptable degree of flexibility. Referring to FIG. 6, it is possible of controlling the on/off of 12 LEDs by means of four electrical wires 11, 12, 13, and 14. Similarly, it is possible of controlling the on/off of 20 LEDs by means of five electrical wires. In short, the invention can control on/off of a plurality of LEDs by means of a relative small number of electrical wires as compared with the prior art.

While the invention herein disclosed has been described by means of specific embodiments, numerous modifications and variations could be made thereto by those skilled in the art without departing from the scope and spirit of the invention set forth in the claims.

What is claimed is:

1. An elongated rope light, comprising:

an elongated mounting strap including an elongate, axial groove and two side ridges;

a first and a second electric wires longitudinally extended along the ridges;

a first and a second illuminating units on the groove, each illuminating unit being electrically coupled between the electrical wires, and including a plurality of LEDs fixed on a circuit board wherein the LEDs in each illuminating unit are electrically coupled together in series by connecting conductive wires therebetween; the first LED is electrically coupled to a positive terminal of the illuminating unit; the last LED is electrically coupled to a negative terminal of the illuminating unit; a positive terminal of the first illuminating unit is electrically coupled to the first electrical wire, and a negative terminal thereof is electrically coupled to the second electrical wire, and a positive terminal of the second illuminating unit is electrically coupled to the second electrical wire, and a negative terminal thereof is electrically coupled to the first electrical wire; and an outer cover layer for enclosing the first and the second electrical wires, and the first and the second illuminating units by means of injection molding, whereby applying a positive voltage to the first electrical wire with respect to the second electrical wire will lighten up the first illuminating unit with the second illuminating unit off, applying a positive voltage to the second electrical wire with respect to the first electrical wire will lighten up the second illuminating unit with the first illuminating units off.

2. The rope light of claim 1, wherein the rope light has a section of square.

3. The rope light of claim 1, wherein the rope light has a section of flat rectangle.

4. The rope light of claim 1, wherein the rope light has a section of oval.

5. The rope light of claim 1, wherein the LED is a plate-shaped LED, COB (chip on board) type LED, SMD (surface mounting) LED, or LED dice bonding fixed on a circuit board by soldering extended conductive wires of the LED on the circuit board.

6. An elongated rope light, comprising:

two or more electrical wires longitudinally extended therealong; and one or more pairs of first and second illuminating units, each pair being electrically coupled between any two electrical wires, each illuminating unit including a plurality of LEDs, and the first and the second illuminating units in each pair being connected in parallel;

whereby applying an AC between any two electrical wires sequentially will lighten up the first and the second illuminating units in each pair alternately by enabling current to flow through the LEDs in each illuminating unit toward a predetermined direction when the LEDs are conducted, wherein the LED is a plate-shaped LED, COB (chip on board) type LED, SMD (surface mounting) LED, or LED dice bonding fixed on a circuit board by soldering extended conductive wires of the LED on the circuit board.

* * * * *